US008636443B2

(12) United States Patent
Ries et al.

(10) Patent No.: US 8,636,443 B2
(45) Date of Patent: Jan. 28, 2014

(54) COMPACTOR HAVING ELECTRONICALLY CONTROLLED LIQUID DISPENSING MECHANISM, SYSTEM, AND METHOD

(75) Inventors: Michael W. Ries, Coon Rapids, MN (US); Mark L. Norton, Eden Prairie, MN (US)

(73) Assignee: Caterpillar Paying Products Inc., Minneapolis, MN (US)

( * ) Notice: Subject to any disclaimer, the term of this patent is extended or adjusted under 35 U.S.C. 154(b) by 0 days.

(21) Appl. No.: 13/467,433

(22) Filed: May 9, 2012

(65) Prior Publication Data

US 2013/0223933 A1 Aug. 29, 2013

Related U.S. Application Data

(60) Provisional application No. 61/604,744, filed on Feb. 29, 2012.

(51) Int. Cl.
*E01C 19/00* (2006.01)

(52) U.S. Cl.
USPC ..... 404/84.05; 404/129; 239/1

(58) Field of Classification Search
USPC ..... 404/84.05–84.5, 117, 122–129, 132; 239/1, 71
See application file for complete search history.

(56) References Cited

U.S. PATENT DOCUMENTS

| | | | | |
|---|---|---|---|---|
| 2,430,781 | A * | 11/1947 | Phalor | 404/129 |
| 3,782,634 | A | 1/1974 | Herman | |
| 4,009,967 | A * | 3/1977 | Layton | 404/129 |
| 4,052,003 | A * | 10/1977 | Steffen | 239/71 |
| 4,157,877 | A * | 6/1979 | Lee | 404/128 |
| 4,637,547 | A * | 1/1987 | Hiniker et al. | 239/1 |
| 5,222,828 | A * | 6/1993 | Magalski | 404/103 |
| 5,494,375 | A * | 2/1996 | Yates | 404/126 |
| 6,520,717 | B1 * | 2/2003 | Otto et al. | 404/122 |
| 6,827,524 | B2 * | 12/2004 | Starry et al. | 404/129 |
| 7,575,395 | B2 * | 8/2009 | Stridiron et al. | 404/84.1 |
| 8,349,598 | B2 * | 1/2013 | Vogel | 435/173.5 |
| 2003/0148029 | A1 | 8/2003 | Rosa | |
| 2004/0018053 | A1 * | 1/2004 | Starry et al. | 404/129 |
| 2006/0102759 | A1 | 5/2006 | DeLong | |
| 2008/0185455 | A1 | 8/2008 | Crum | |
| 2011/0052319 | A1 | 3/2011 | Marsolek et al. | |

FOREIGN PATENT DOCUMENTS

| | | |
|---|---|---|
| JP | 2000064219 | 2/2000 |
| KR | 100164239 | 2/1999 |
| WO | 2004011725 | 2/2004 |

* cited by examiner

*Primary Examiner* — Raymond W Addie
(74) *Attorney, Agent, or Firm* — Liell & McNeil

(57) ABSTRACT

A compactor includes a rotatable compacting element, and a dispensing mechanism for dispensing a liquid onto an outer surface of the compacting element to prevent sticking of paving material. The compactor further includes an electronic control mechanism configured to activate the dispensing mechanism, and further configured to deactivate the dispensing mechanism responsive to data indicating an extent of coverage of the outer surface with the liquid is sufficient. Related systems and methodology are also disclosed.

20 Claims, 3 Drawing Sheets

COMPACTOR HAVING ELECTRONICALLY CONTROLLED LIQUID DISPENSING MECHANISM, SYSTEM, AND METHOD

RELATION TO OTHER PATENT APPLICATION

This application claims priority to provisional patent application 61/604,744, filed Feb. 29, 2012 with the same title.

TECHNICAL FIELD

The present disclosure relates generally to applying a liquid to a rotatable compacting element in a compactor to prevent sticking of paving material, and relates more particularly to controllably dispensing the liquid to achieve a desired extent of coverage of the compacting element.

BACKGROUND

A variety of different machines are known and widely used for compacting a substrate of material such as paving material and various types of soil. In the context of paving systems, compactors are typically either equipped with metallic cylindrical drums, or pneumatic compacting elements formed from rubber or rubber-like materials. A common practice for certain paving endeavors is to employ multiple compactors in a single paving train.

A first compactor typically follows behind a paver and "breaks down" paving material placed by the paver upon a sub-grade, performing an initial treatment to render the paving material suitable for subsequent work. A second compactor may follow behind the leading compactor and performs what is often described as "kneading" of the paving material, to mix and homogenize the paving material in preparation for working by a finish roller.

Paving material is typically comprised of viscous hydrocarbons, and gravel or the like. The paving material is deposited at a relatively high temperature, and cools to harden into a finished product. It is well known that the hot, viscous hydrocarbon constituents of paving material can stick to machinery in a paving train. Where paving material sticks to ground contacting parts of the machinery, such as the rotating drums or tires of compactors, the quality of the paving material mat can suffer, and continued operation of the machinery can itself be compromised.

Various on-board spray systems configured to spray water, release agents and the like, onto rotating compacting elements are used to prevent the paving material from adhering. One conventional spray system is known in the context of drum compactors, and continuously and autonomously sprays water onto the compacting drums whenever the compactor is moving. Systems are also known for pneumatic compactors which spray water or an emulsion onto the tires. In the case of pneumatic compactors, it is typically unnecessary to continuously spray the tires to prevent sticking of the paving material, and thus the operator is often given control over the spray system to apply the liquid at his/her discretion. While various known systems have been sufficient for many years, there remains ample room for improvement in the manner in which liquid spraying systems for compactors are designed and controlled.

SUMMARY

In one aspect, a compactor includes a frame, and a compacting element rotatably coupled to the frame and having an outer surface configured to rotate in contact with a substrate of paving material. The compactor further includes a dispensing mechanism for dispensing a liquid onto the outer surface to prevent sticking of the paving material, and an electronic control mechanism in communication with the dispensing mechanism. The electronic control mechanism is configured to command activation of the dispensing mechanism such that the liquid is dispensed during rotating the compacting element, and further configured to receive data indicative of an extent of coverage of the outer surface with the liquid and responsively command deactivation of the dispensing mechanism.

In another aspect, a system, for preventing sticking of paving material to an outer surface of a rotatable compacting element in a compactor, includes a dispensing mechanism having a deactivated state, and an activated state for dispensing a liquid onto the outer surface during rotating the compacting element. The system further includes an electronic control mechanism in communication with the dispensing mechanism, the electronic control mechanism being configured to receive a request indicative of a desired extent of coverage of the outer surface with the liquid, and responsively command activation of the dispensing mechanism. The electronic control mechanism is further configured to receive data indicative of an actual extent of coverage of the outer surface with the liquid, and responsively command deactivation of the dispensing mechanism.

In another aspect, a method of applying a liquid for preventing sticking of paving material to a rotatable compacting element in a compactor includes receiving a request indicative of a desired extent of coverage of an outer surface of the compacting element with the liquid, and commanding activation of a dispensing mechanism for the liquid responsive to the request. The method further includes receiving data indicative of an actual extent of coverage of the rotatable compacting element with the liquid, and commanding deactivation of the dispensing mechanism responsive to received data indicating the actual extent of coverage is equal to the desired extent of coverage.

DETAILED DESCRIPTION

Figure 1:
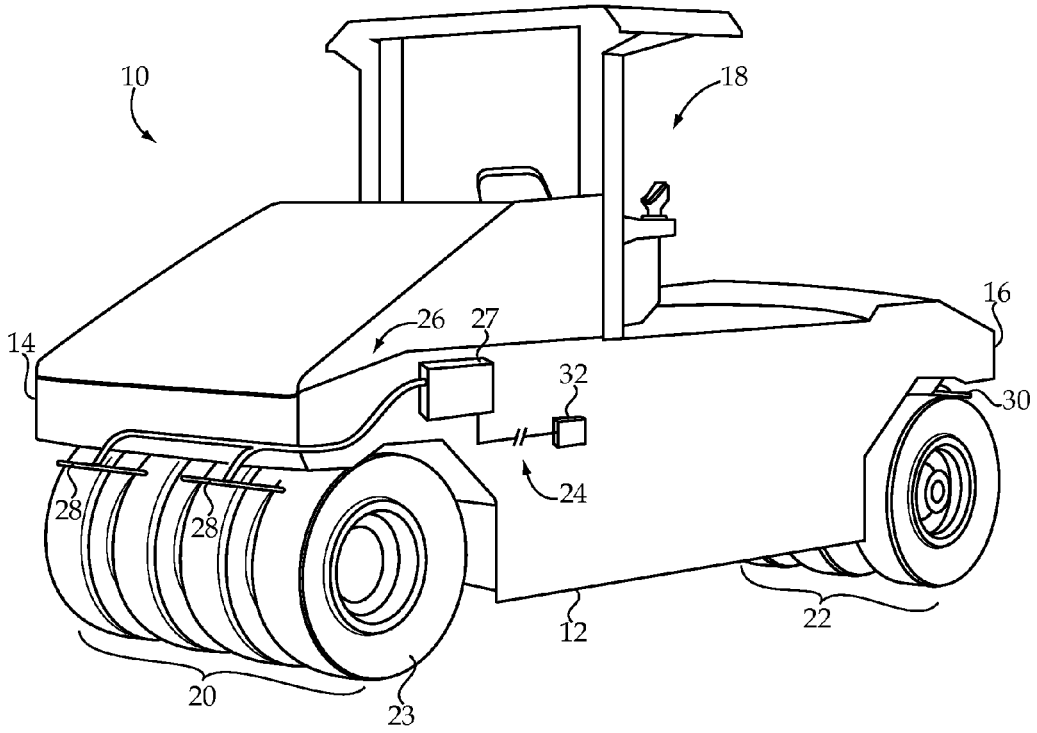
FIG. 1 is a diagrammatic view of a compactor according to one embodiment.

Referring to FIG. 1, there is shown a compactor 10 according to one embodiment, and including a frame 12 having a front frame end 16 and a back frame end 14. An operator control station 18 is coupled to frame 12 between front frame end 16 and back frame end 14 in a conventional manner. Compactor 10 further includes a compacting element 20 rotatably coupled to frame 12 and having an outer surface 23 configured to rotate in contact with a substrate of paving material beneath compactor 10. In the illustrated embodiment, compactor 10 includes a front set of compacting elements 22, and a back set of compacting elements 20, each of which includes a set of four tires. Descriptions herein of one of the compacting elements should be understood to refer similarly to all of the compacting elements unless otherwise indicated. A practical implementation of the present disclosure is in the context of pneumatic compactors, such as compactor 10, where the compacting elements are tires formed from rubber or a rubber-like material.

Compactor 10 may further include a system 24 for preventing sticking of paving material to compacting elements 20 and 22. System 24 may include a dispensing mechanism 26, for dispensing a liquid onto outer surface 23, and the corresponding outer surfaces of the other compacting elements, to prevent sticking of the paving material. The dispensed liquid may include a known emulsion, water, or any other suitable liquid or liquid mixture. Emulsions for such purposes are readily commercially available and are generally understood to be superior to other liquids, albeit more expensive. As will be further apparent from the following description, compactor 10, and in particular system 24, may be uniquely configured to control dispensing of the emulsion or other liquid to obtain an extent of coverage of compacting elements 20 and 22 which is requested by an operator, and thus avoiding waste or insufficient coverage. It is contemplated that spraying liquid as described herein may take place during "seasoning" compacting elements, just prior to driving onto a fresh mat of paving material, however, the present disclosure is not thereby limited.

Dispensing mechanism 26 may include a fluid supply 27, one or more back sprayers 28 each configured to spray liquid from fluid supply 27 onto one or more of back compacting elements 20, and one or more analogously configured front sprayers 30. System 24 may further include an electronic control mechanism 32, including for example a computer and a computer readable memory storing computer executable code, in communication with dispensing mechanism 26 and configured to command activation of dispensing mechanism 26 such that the liquid is dispensed during rotating compacting elements 20 and 22, in other words during moving compactor 10. Electronic control mechanism 32 may be further configured to receive data indicative of an extent of coverage of outer surface 23, and the corresponding outer surfaces of the other compacting elements, with the liquid and responsively command deactivation of dispensing mechanism 26. In certain, embodiments, electronic control mechanism 32 may command the activation of dispensing mechanism responsive to an operator generated request which is indicative of a desired and selectable extent of coverage of outer surface 23.

Figure 2:
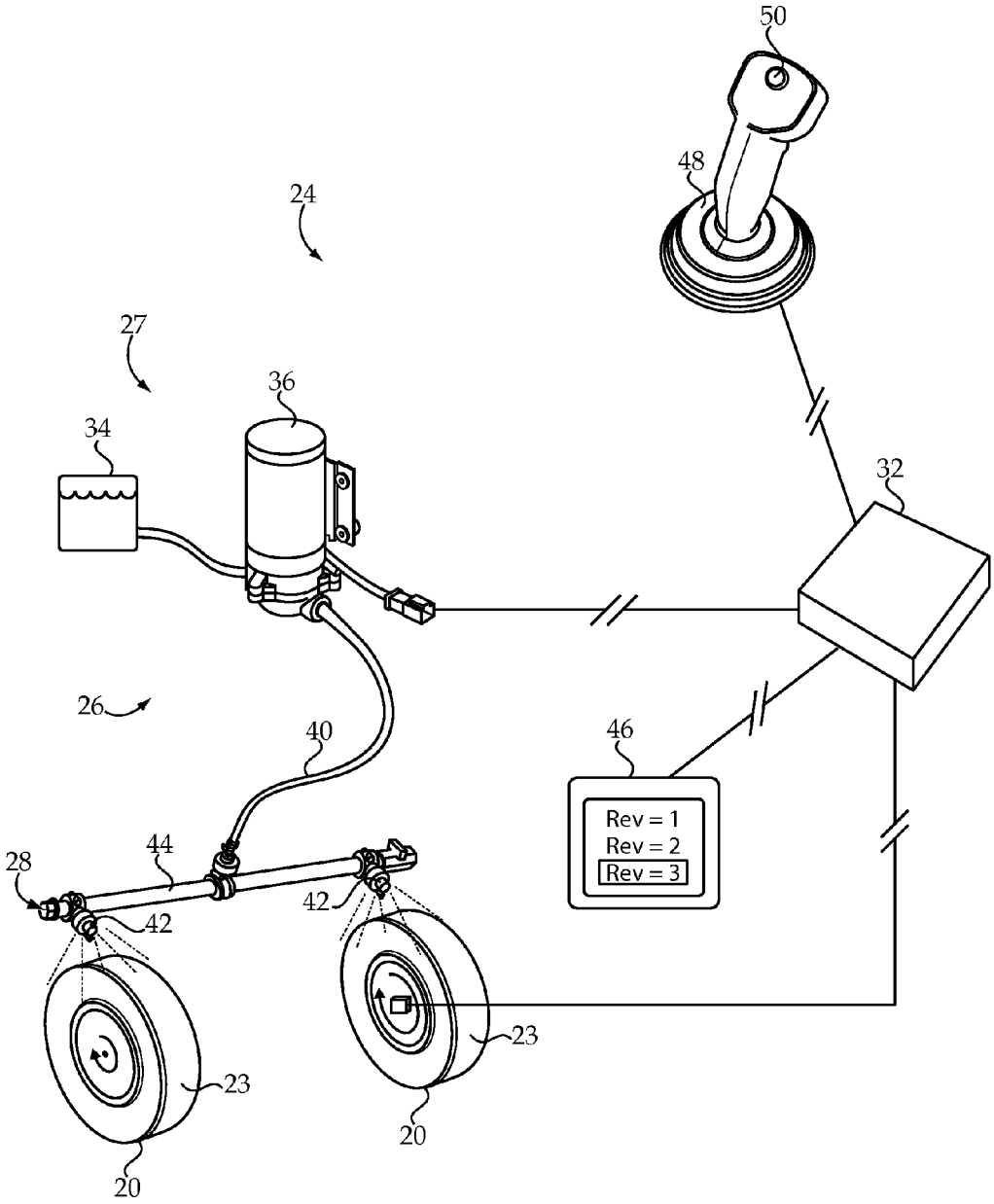
FIG. 2 is a diagrammatic view of a system for preventing sticking of paving material to a compacting element in a compactor, according to one embodiment.

Referring now also to FIG. 2, there are shown additional features of system 24. Fluid supply 27 may include a tank 34 configured to contain the liquid to be sprayed, and a pump 36 configured to convey the liquid from tank 34 to the various sprayers of system 24. In a practical implementation strategy, dispensing mechanism 26 includes an unobstructed fluid conduit 40 extending from pump 36 to sprayer 28, such that turning on pump 36 results in the liquid being conveyed to sprayer 28, and turning off pump 36 has the opposite effect. Accordingly, control mechanism 32 may be configured to command the activation and deactivation of dispensing mechanism 26 via commanding turning pump 36 on and off respectively. Another unobstructed fluid conduit may analogously convey the liquid to front sprayer(s) 30. In other embodiments, dispensing mechanism 26 might be equipped with valves, accumulators, or other hardware configured such that activating and deactivating mechanism 26 might take place by means other than simply turning on and turning of pump 36.

Sprayer 28 may have the form of a spray bar 44 configured to extend across and in front of outer surfaces 23, and further having a plurality of spray orifices 42 oriented to spray the liquid onto outer surfaces 23. The front sprayer 30 may also include at least one front spray bar having an analogously oriented plurality of spray orifices. Also shown in FIG. 2 is a display 46, which may be positioned at operator control station 18, an operator input device 48 having a control button 50, and a sensing mechanism 38 configured to generate the data of interest to control mechanism 32, as further described herein.

In a practical implementation strategy, sensing mechanism 38 may be a rotation sensor for one of compacting elements 20, in communication with control mechanism 32. Additionally or alternatively rotation sensing of one of compacting elements 22 might be performed for analogous purposes. The data received by control mechanism 32, and generated via rotation sensor 38, may be indicative of a sensed number of actual revolutions of the corresponding compacting element 20 while dispensing mechanism 26 is activated. Accordingly, with dispensing mechanism 26 activated such that the liquid is sprayed onto outer surfaces 23 during rotating compacting elements 20, 22, rotation sensor 38 may sense the revolutions of the corresponding compacting element 20. This number of revolutions will in turn indicate an extent of coverage of the corresponding outer surface 23 with the liquid. For instance, one revolution while dispensing mechanism 26 is activated indicates that an entire circumference of the corresponding compacting element 20 has been covered, in other words coated, with the liquid one time. Two sensed revolutions would be understood to indicate two coats applied to the entire circumference. One and a half revolutions would indicate one coating upon the entire circumference, and a second coating upon approximately one half of the circumference. By monitoring revolutions of one or more of compacting elements 20 in this general manner, control mechanism 32 can determine, or otherwise act responsive to, an actual extent of coverage of compacting elements 20 with the liquid, and command deactivation of dispensing mechanism 26 such that a desired extent of coverage is obtained.

It will be recalled that control mechanism 32 may command activation of dispensing mechanism 26 responsive to a request indicating a desired extent of coverage. In a practical implementation strategy, the received request may be indicative of a number of desired revolutions of compacting elements 20 while dispensing mechanism 26 is activated. Control mechanism 32 may compare the number of desired revolutions with the number of actual revolutions as indicated via data from sensor 38, and command the deactivation of dispensing mechanism 26 responsive to comparing the number of actual revolutions with the number of desired revolutions. In one embodiment, the number of desired revolutions may be a selectable whole number of revolutions, and control mechanism 32 may be configured to command the deactivation responsive to data indicating a whole number of sensed revolutions, for instance where the whole number of sensed revolutions is equal to a whole number of desired revolutions as indicated by the request. It has been discovered that complete coverage of compacting elements 20 consistent with a desired extent of coverage may be assured by deactivating dispensing mechanism 26 slightly after a sensed number of revolutions equal to the desired number of revolutions occurs. Another way to understand this principle, is that dispensing mechanism 26 may remain active beyond the point at which a desired extent of coverage appears to have been obtained to compensate for potential errors. Control mechanism 32 may be configured to command the deactivation responsive to the number of actual revolutions exceeding the number of desired revolutions by a fractional amount. For instance, where 3 revolutions are requested, control mechanism 32 might command deactivation of pump 36 upon sensing 3.1, 3.2, or some other number of actual revolutions greater than 3. In a practical implementation strategy, a one-eight fractional revolution beyond an actual number of revolutions equal to the desired number may trigger the deactivation. It will thus be appreciated that mechanism 32 may command the deactivation responsive to the actual extent of coverage being equal to the desired extent, but after allowing the additional fractional revolution as a buffer to reduce the risk of under-spraying. In one embodiment, system 24 may also be configured via quadrature and quarter encoding, for example, to sense each of position, direction of rotation, and velocity of rotation of the corresponding compacting element 20, the significance of which will be apparent from the following description.

INDUSTRIAL APPLICABILITY

Figure 3:
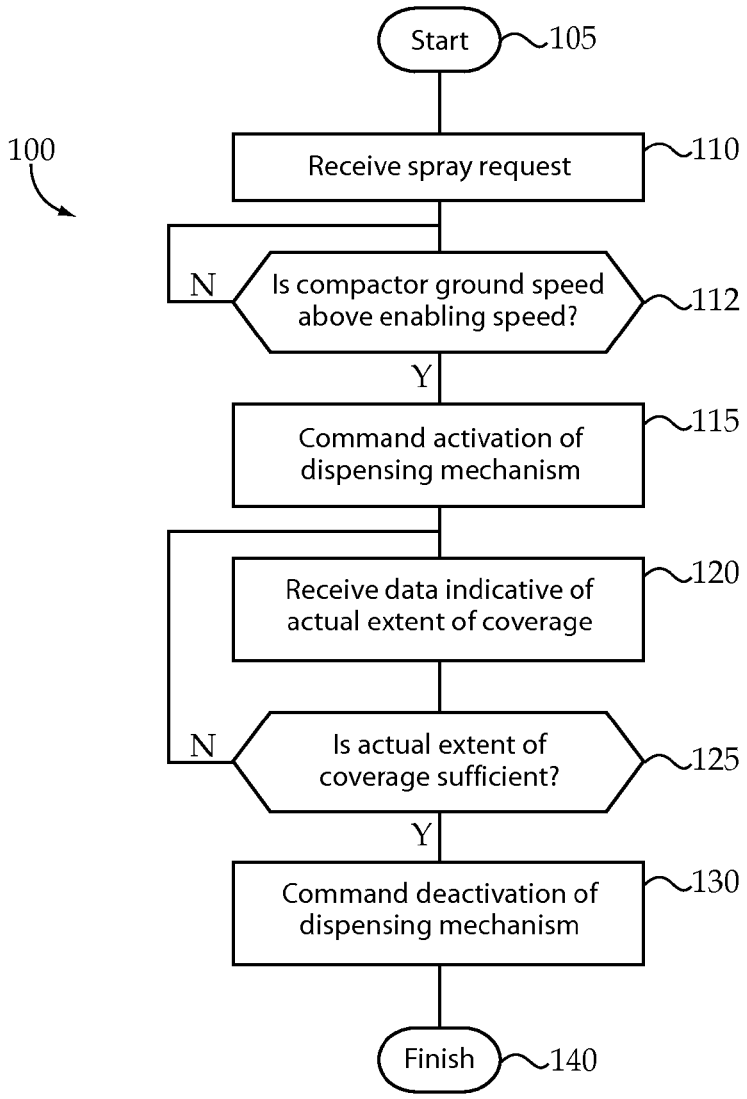
FIG. 3 is a flowchart illustrating an example control process according to the present disclosure.

Referring now also to FIG. 3, there is shown a flowchart 100 illustrating an example control process according to the present disclosure. The process of flowchart 100 may start at step 105, and then proceed to step 110 to receive a spray request. It will be recalled that activation of dispensing mechanism 26 to spray the liquid may be requested via operator input device 48. In particular, control button 50, or some other control mechanism such as a touch screen, keypad, or lever, may be depressed or otherwise used by an operator to request a selected number of revolutions defining the desired extent of coverage. A selectable number of revolutions might include 1, 2 or 3, for example. A lesser number of revolutions may be appropriate for cooler asphalt, or a thinner lift, whereas a greater number may be appropriate for a thicker and/or hotter lift. In FIG. 2, display 46 shows three icons, REV=1, REV=2, and REV=3, the last of which is highlighted to indicate an example operator request for three revolutions of compacting elements 20 while dispensing mechanism 26 is activated. Display 46 might additionally or alternatively indicate status of system 24 via displaying an "emulsion on" icon or the like. In any event, button 50 may be used to output a control signal encoding the requested number of revolutions to control mechanism 32, or be interrogated by mechanism 32, and the process may proceed to step 110.

Control mechanism 32 may be configured via receipt of data from sensor 38, for instance, to determine compactor ground speed. Those skilled in the art will appreciate that information as to a speed of rotation of a ground engaging element can be used to determine a ground speed of the associated machine. Alternative techniques for monitoring ground speed include global positioning system data, local positioning system data, or data from some other sensing mechanism resident on compactor 10. At step 110, control mechanism 32 may query whether compactor ground speed is above an enabling speed. If no, the process may loop back to execute step 110 again. If yes, the process may proceed ahead to step 115 in which control mechanism 32 may command activation of dispensing mechanism 26 as described herein. It will be appreciated that it may be generally undesirable to spray the liquid onto compacting elements 20 when compactor 10 is stopped. For this reason, step 110 may be understood as determining whether compactor 10 is actually moving, or moving fast enough, such that an excess of liquid will not be sprayed onto any one part of compacting elements 20 prior to reaching a desired extent of coverage. From step 115, the process may proceed to step 120 to receive data indicative of an actual extent of coverage, such as the revolution data for one or more of compacting elements 20 as described herein. From step 120, the process may proceed to step 125 at which control mechanism 32 may query whether the actual extent of coverage is sufficient. The actual extent of coverage may be sufficient where a number of sensed revolutions, which defines the actual extent of coverage, is equal to the number of desired revolutions, which defines the desired extent of coverage, as described herein. If no, the process may loop back to execute step 120 again. If yes, the process may proceed to step 130 at which control mechanism 32 may command deactivation of dispensing mechanism 26, potentially after continued spraying for a fractional revolution, and thenceforth end at step 135. The foregoing description contemplates autonomous, or at least partially autonomous, operation. System 24 might also have a manual mode, enabled via a different control button or via interacting with a menu displayed on display 46, in which liquid spray begins and ends at the whim of an operator.

In parallel with, or as a subroutine of, the process set forth in flowchart 100, control mechanism 32 may be continuously or periodically monitoring ground speed of compactor 10 to determine if conditions justify stopping dispensing of the liquid. For instance, control mechanism 32 may command stopping dispensing a liquid where the ground speed drops to a disabling ground speed such as below 0.1 km per hour, and subsequently command restarting dispensing the liquid where the ground speed returns to an enabling ground speed, equal to or greater than 0.1 km per hour for example. Control mechanism 32 may be further configured to add a number of actual revolutions preceding the stopping of dispensing the liquid to a number of actual revolutions succeeding the restarting of dispensing. Another way to understand this feature is that control mechanism 32 may suspend spraying compacting elements 20 with the liquid when compactor 10 is stopped, or nearly stopped, restart spraying when compactor 10 begins to move again, and can then add together the whole or partial revolutions preceding and succeeding the stopping of spraying, to determine whether the actual extent of coverage is sufficient. Accordingly, control mechanism 32 may command the deactivation responsive to a sum of the numbers of preceding and succeeding actual revolutions. This capability can generally prevent over-spraying and under-spraying compacting elements 20 by accounting for situations where the liquid would be continuously spraying the same part of outer surface 23, instead of outer surface 23 advancing through the liquid spray. The quadrature and quarter encoding configuration of system 24, or any other suitable configuration, also enables control mechanism 32 to determine when compactor 10 is reversing. In particular, the sensed actual revolutions may include forward revolutions, and control mechanism 32 may be configured to detect a reverse revolution of compacting element 20, and responsively reset a counted number of forward revolutions to zero. Upon detecting a reverse revolution, control mechanism 32 may also disable system 24, such that an operator will then need to reactivate system 24 if further spraying is desired.

In view of the foregoing discussion, it will be appreciated that the presently disclosed strategy of deactivating a liquid dispensing mechanism in a compactor responsive to data indicative of an extent of coverage of an outer surface of a compacting element may be implemented in a variety of ways. As discussed herein, data might be received from sources other than a rotation sensor which could nevertheless similarly indicate the extent of coverage. Counting forward revolutions of a rotatable compacting element is nevertheless contemplated as a strategy which is both relatively simple and reliable, and employs readily available hardware. In alternative and expanded versions, a volume or mass of liquid applied might also be monitored to provide a secondary or backup check to bolster the reliability of the revolution data.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A compactor comprising:

a frame;

a compacting element rotatably coupled to the frame and having an outer surface configured to rotate in contact with as substrate of paving material;

a dispensing mechanism for dispensing a liquid onto the outer surface to prevent sticking of the paving material; and an electronic control mechanism in communication with the dispensing mechanism and configured to command activation of the dispensing mechanism such that the liquid is dispensed during rotating the compacting element;

the electronic control mechanism being further configured to receive data indicative of an extent of coverage of the outer surface with the liquid and responsively command deactivation of the dispensing mechanism; and the electronic control mechanism being further configured to command activation and deactivation of the dispensing mechanism when a change of a travel direction of the compactor is sensed, wherein the travel direction is a forward direction and a reverse direction.

2. The compactor of claim 1 wherein the data is indicative of a circumferential extent of coverage of the outer surface with the liquid.

3. The compactor of claim 2 further comprising a rotation sensor configured to sense revolutions of the compacting element, and wherein the data is indicative of a number of the sensed revolutions while the dispensing mechanism is activated.

4. The compactor of claim 3 wherein the electronic control mechanism is configured to command the deactivation responsive to received data indicating, a whole number of sensed revolutions.

5. The compactor of claim 2 wherein the dispensing mechanism includes a tank, a sprayer, and a pump configured to convey the liquid from the tank to the sprayer.

6. The compactor of claim 5 wherein the dispensing mechanism further includes an unobstructed fluid conduit extending from the pump to the sprayer, and wherein the electronic control mechanism is configured to command the activation and the deactivation via commanding turning the pump on and off, respectively.

7. The compactor of claim 5 wherein the compacting element is one of a plurality of pneumatic compacting elements of the compactor.

8. The compactor of claim 7 wherein the plurality of pneumatic compacting elements include a front set of tires, and a back set of tires, and wherein the sprayer includes at least one front spray bar having a first plurality of spray orifices oriented to spray the liquid onto outer surfaces of the front set of tires, and at least one back spray bar having a second plurality of spray orifices oriented to spray the liquid onto outer surfaces of the back set of tires.

9. A system far preventing sticking of paving material to an outer surface of a rotatable compacting element in a compactor comprising:

a dispensing mechanism having a deactivated state, and an activated state for dispensing a liquid onto the outer surface during rotating the compacting element; and an electronic control mechanism in communication with the dispensing mechanism, the electronic control mechanism being configured to receive a request indicative of a desired extent of coverage of the outer surface with the liquid, and responsively command activation of the dispensing mechanism;

the electronic control mechanism being further configured to receive data indicative of an actual extent of coverage of the outer surface with the liquid, and responsively command deactivation of the dispensing mechanism; and the electronic control mechanism being further configured to command activation and deactivation of the dispensing mechanism when a change of a travel direction of the compactor is sensed, wherein the travel direction is a forward direction and a reverse direction.

10. The system of claim 9 wherein the request is indicative of a number of desired revolutions of the compacting element while the dispensing mechanism is activated, and the data is indicative of a number of revolutions of the compacting element while the dispensing mechanism is activated.

11. The system of claim 10 further comprising a rotation sensor for the compacting element in communication with the electronic control mechanism, and configured to sense the revolutions of the compacting element.

12. The system of claim 11 wherein the electronic control mechanism is further configured to compare the number of sensed revolutions with the number of desired revolutions, and to command the deactivation responsive to comparing the number of sensed revolutions with the number of desired revolutions.

13. The system of claim 12 wherein the electronic control mechanism is further configured to command the deactivation responsive to the number of sensed revolutions exceeding the number of desired revolutions by a fractional amount.

14. The system of claim 11 wherein the electronic control mechanism is further configured to monitor a ground speed of the compactor, to command stopping dispensing the liquid where the ground speed drops to a disabling ground speed, and to subsequently command restarting dispensing the liquid where the ground speed returns to an enabling ground speed.

15. The system of claim 14 wherein the electronic control mechanism is configured to add a number of sensed revolutions preceding the stopping of dispensing to a number of sensed revolutions succeeding the restarting of dispensing, and further configured to command the deactivation responsive to a sum of the numbers of preceding and succeeding revolutions.

16. A method of applying a liquid for preventing sticking of paving material to a rotatable compacting element in a compactor, the method comprising the steps of:

receiving a request indicative of a desired extent of coverage of an outer surface of a compacting element with the liquid;

commanding, activation of a dispensing mechanism for the liquid responsive to the request;

receiving data indicative of an actual extent of coverage of the rotatable compacting element with the liquid;

commanding deactivation of the dispensing mechanism responsive to received data indicating the actual extent of coverage is equal to the desired extent of coverage; and commanding activation and deactivation of the dispensing mechanism when a change of a travel direction of the compactor is sensed, wherein the travel direction is a forward direction and a reverse direction.

17. The method of claim 16 wherein the step of receiving the request includes receiving a requested number of revolutions of the compacting element defining the desired extent of coverage, and further comprising a step of counting a number of revolutions of the compacting element defining the actual extent of coverage.

18. The method of claim 17 further comprising the steps of stopping dispensing the liquid when a ground speed of the compactor drops to a disabling ground speed, and subsequently restarting dispensing the liquid when the ground speed returns to an enabling ground speed, and wherein the step of counting further includes adding a number of the revolutions preceding the stopping of dispensing to a number of the revolutions succeeding the restarting of dispensing.

19. The method of claim 17 wherein the step of counting includes counting forward revolutions, and further comprising the steps of detecting a reverse revolution of the compacting element and responsively resetting a count of the number of revolutions to zero.

20. The method of claim 16 further comprising the steps of turning on a pump in response to the commanding of activation, and spraying the liquid onto outer surfaces of a set of tires which includes the rotatable compacting element, responsive to turning on the pump.

* * * * *

UNITED STATES PATENT AND TRADEMARK OFFICE

CERTIFICATE OF CORRECTION

PATENT NO. : 8,636,443 B2
APPLICATION NO. : 13/467433
DATED : January 28, 2014
INVENTOR(S) : Ries et al.

It is certified that error appears in the above-identified patent and that said Letters Patent is hereby corrected as shown below:

Title Page, Column 1, Item no. 73 (Assignee), line 1, delete "Caterpillar Paying Products Inc.," and insert -- Caterpillar Paving Products Inc., --.

In the Specification

Column 3, lines 38-39, delete "In certain, embodiments," and insert -- In certain embodiments, --.

Column 3, line 60, delete "turning of" and insert -- turning off --.

In the Claims

Column 7, line 12, in Claim 1, delete "with as substrate" and insert -- with a substrate --.

Column 7, line 40, in Claim 4, delete "indicating, a whole number" and insert -- indicating a whole number --.

Column 7, line 62, in Claim 9, delete "A system far preventing" and insert -- A system for preventing --.

Column 8, line 56, in Claim 16, delete "commanding, activation" and insert -- commanding activation --.

Signed and Sealed this
Fifteenth Day of September, 2015

Michelle K. Lee

Michelle K. Lee
*Director of the United States Patent and Trademark Office*